US006871386B2

(12) United States Patent
Chen-Lieh

(10) Patent No.: US 6,871,386 B2
(45) Date of Patent: Mar. 29, 2005

(54) HEADBAND ADJUSTMENT DEVICE

(75) Inventor: Pan Chen-Lieh, Shrlin (TW)

(73) Assignee: QDS Injection Molding LLC, Rancho Santa Fe, CA (US)

( * ) Notice: Subject to any disclaimer, the term of this patent is extended or adjusted under 35 U.S.C. 154(b) by 0 days.

(21) Appl. No.: 10/626,660

(22) Filed: Jul. 25, 2003

(65) Prior Publication Data

US 2004/0226146 A1 Nov. 18, 2004

(51) Int. Cl.[7] ..... A44B 11/06
(52) U.S. Cl. ..... 24/168; 24/68 E; 24/71.1
(58) Field of Search ..... 24/168, 171, 68 BT, 24/68 A, 68 E, 71.1, 194, 3.1, 3.3, 136 R, 308, 309, 310, 329, 330, 331, 335, 336, 338, 633, 634, 640, 642, 652, 662, 664, 484; 2/173, 452, 426

(56) References Cited

U.S. PATENT DOCUMENTS 3,992,720 A * 11/1976 Nicolinas ..... 2/418
4,607,398 A * 8/1986 Faulconer ..... 2/452
4,795,384 A * 1/1989 Hattori ..... 24/191
4,999,846 A * 3/1991 Ball et al. ..... 24/68 E
5,467,508 A * 11/1995 Feng ..... 24/68 SK
6,185,794 B1 * 2/2001 Maggi ..... 24/170

* cited by examiner

*Primary Examiner*—Robert J. Sandy
(74) *Attorney, Agent, or Firm*—Troxell Law Office, PLLC

(57) ABSTRACT

A headband adjustment device includes a base, an adjustable seat, at least a press piece, a resilient adjustment plate and two band shafts. The base provides a base through hole. The adjustable seat is joined to the base an has a wing plate at two opposite lateral sides and an adjustment frame at two ends. The press piece is disposed beside the respective wing plate with two ends extending a press slant end. The adjustment plate is fiat with a middle protrusion top and at both lateral sides of the protrusion top having a fixing projection respectively, at a bottom near both ends having a lift guide groove with a plate slant extending toward the two ends respectively to interfere with ratchet gears on the headband. The band shafts each have an end projection and the headband encloses the respective band shaft and extends outward inversely.

11 Claims, 2 Drawing Sheets

HEADBAND ADJUSTMENT DEVICE

BACKGROUND OF THE INVENTION

1. Field of the Invention

The present invention relates to a headband adjustment device and particularly to an adjustment device attached to a head enclosing apparatus especially such as lunettes for loosening or tightening a headband by way of a resilient adjustment plate.

2. Description of Related Art

It is quite often that a variety of head wearable tools such as headbands, helmets, lunettes, protective spectacles and headlamps are used in our daily lives. The major requirements of the head wearable tools are in that they have to be comfortable during being worn and the tightness thereof has to be adjustable so as to fit different head measurements. In fact, adjustable tightness can enhance the wearing comfort to some extent.

Taking the conventional lunettes as an example, the headband adjustment device is an essential part for the lunettes and disposed at both lateral sides of the lunettes so as to be adjusted the tightness thereof. However, it is inconvenient that the adjustment device at both lateral sides of the lunettes has to be adjusted and the adjustment device has spoiled the facial smoothness of the wearer. In addition, the adjustment device has increased the gross size of the lunettes such that they become not easy for the lunettes to be worn or carried about.

Another type of conventional lunettes has the adjustment device be disposed at the back of the head but it is provided with a complicated way for tightness adjustment.

SUMMARY OF THE INVENTION

A primary object of the present invention is to provide a headband adjustment device, which includes a base, an adjustment seat, at least a press piece, a resilient adjustment plate and two band shafts. The base provides a base through hole. The adjustment seat is joined to the base and has a wing plate at two opposite lateral sides thereof and an adjustment frame at two ends thereof. The press piece is disposed beside the respective wing plate with two ends thereof extending a press wedge end. The adjustment plate is flat with a middle protrusion top and at both lateral sides of the protrusion top having a fixing projection respectively, at a bottom near both ends thereof having a lift guide groove with a plate slant extending toward the two ends respectively to interfere with ratchet gears on the headband. The band shafts each have an end projection and the headband encloses the respective band shaft and extends outward inversely via the adjustment frame so as to be held in place with the ratchet teeth engaging with the adjustment plate. When the press piece is pressed, the press slant ends lift the guide grooves to increase the space between the adjustment plate and the band shafts for the headband being adjusted.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
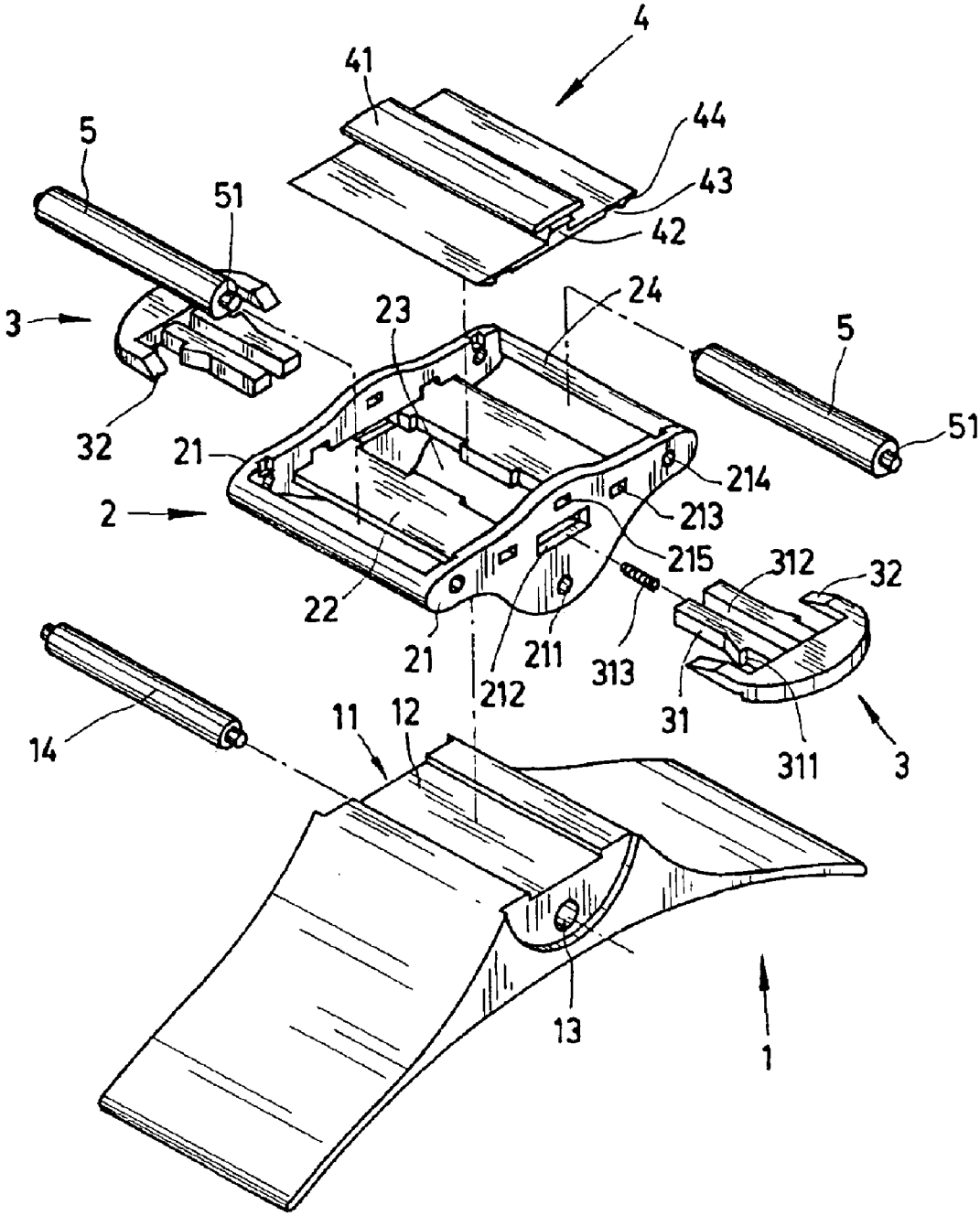
FIG. 1 is an exploded perspective view of a headband adjustment device according to the present invention.

Referring to FIG. 1, basically, a headband adjustment device according to the present invention includes a base 1, a adjustable seat 2, two press pieces 3, a resilient adjustment plate 4 and two band shafts 5.

Wherein, the base 1 is solid and is used for contacting with the head of a wearer so that the bottom thereof is preferable to have an arched shape with soft material for keeping in touch with the head of the wearer. The top, i.e., the central area at the outer side of the base 1, is a flat base surface 11 with a base groove 12 across two lateral sides thereof. Further, a base hole 13 is provided below the base groove 12 to pass through the two lateral sides. Basically, the base 1 in FIG. 1 has a configuration with a thick middle part and two thin end parts, but it is noted that the preceding configuration is not a limitation. In order to be fixed with the adjustment seat 2, a base pin 14 can be provided to pierce the base hole 13.

The adjustable seat 2 is composed of two lateral wing plates 21 corresponding to the two lateral sides of the base 1 and two horizontal plates 22 disposed inside the lateral wing plates 21. An elongated opening 23 is formed between the two horizontal plates 22 as shown in FIG. 1. Further, each horizontal plate 22 at the outer side thereof has an adjusting frame 24 respectively.

The preceding wing plates 21 each may provide a wing hole 211 corresponding to the base holes 13 with an engaging slot 212 is disposed over the respective wing hole 211. A plate hole 213 is disposed beside two ends of the engaging slot 212 respectively with an elevation thereof slightly higher than the engaging slot 212. Both ends of the respective wing plate 2 are provided with an engaging hole 214 and a guide hole 215 is provided at the central position of the respective wing plate 21 above the engaging slot 212. The wing plates 21 can be glued to the base 1.

The press pieces 3 are used for being pressed by the use and each press piece 3 at the center thereof has two parallel pressing bars 31 corresponding to the engaging slot 212. The pressing bars 31 at the outer sides thereof have a jaw 311 to prevent the respective press piece 3 from disengaging from the engaging slots 212. A bar clearance 312 is formed between the pressing bars 31 to be inserted with a spring 313. Besides, the respective press piece 3 at both ends thereof, which are disposed outside the outer sides of the pressing bars 31, extends a pressing wedge end 32 corresponding to the preceding plate hole 213 so as to be movably inserted into the plate holes 213. Due to the press pieces 3 being oppositely positioned, it is possible for the user to press pieces 3 with two fingers at the same time.

The resilient adjustment plate 4 at the upper middle area thereof has a protrusion top 41 and at both lateral sides thereof has a fixing projection 42 respectively. The bottom of the adjustment plate 4 near both ends thereof has a lift guide groove 43 with a plate slant 44 extending to both ends respectively.

Each of the band shafts 5 at both ends thereof has an end projection 51 for being inserted into the engaging holes 214 for winding the band.

Figure 2:
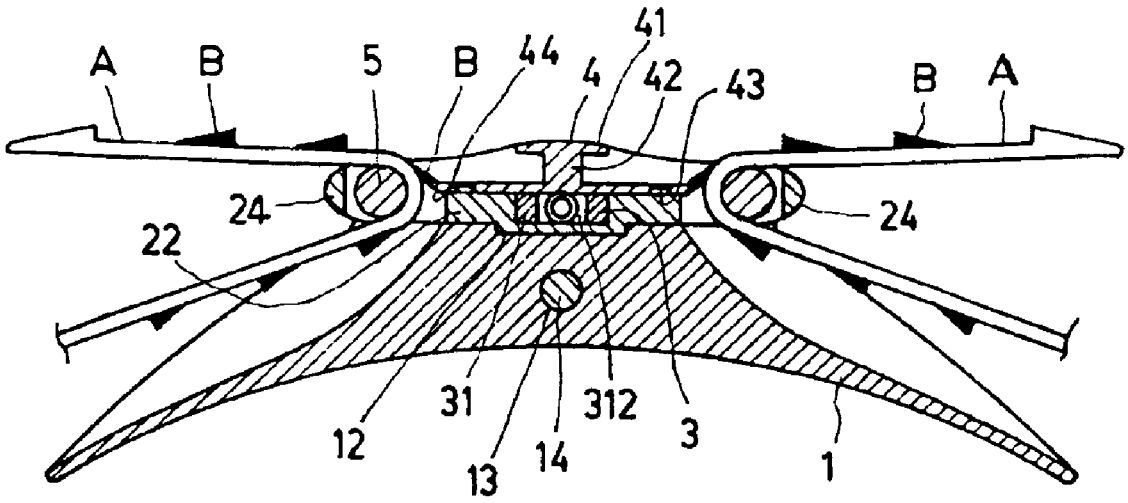
FIG. 2 is a sectional view of the headband adjustment device shown in FIG. 1.

Referring to FIG. 2 in company with FIG. 1, the adjustable seat 2 is joined to the base 1 first with the base pin 14 passing through the wing holes 211 and the base hole 13 while the adjustment device of the present invention is assembled. Next, the press pieces 3 are inserted into the engaging slots 212 respectively with the press slant ends 32 being inserted into the plate holes 213. Then, the springs 313 are placed in the bar clearances 312 and the band shafts 5 are joined to the adjustable seat 2 with the end projections 51 being inserted into the engaging holes 214. Finally, the resilient adjustment plate 4 is joined to the adjustable seat 2 with the fixing projections 42 being engaged to the guide holes 215. FIG. 2 shows the head band A extends outward after enclosing the two band shafts 5 and the head band A is provided with a plurality of unidirectional ratchet teeth B equally spacing apart from each other to resist moving backward as soon as the band is held in place firmly.

Figure 3:
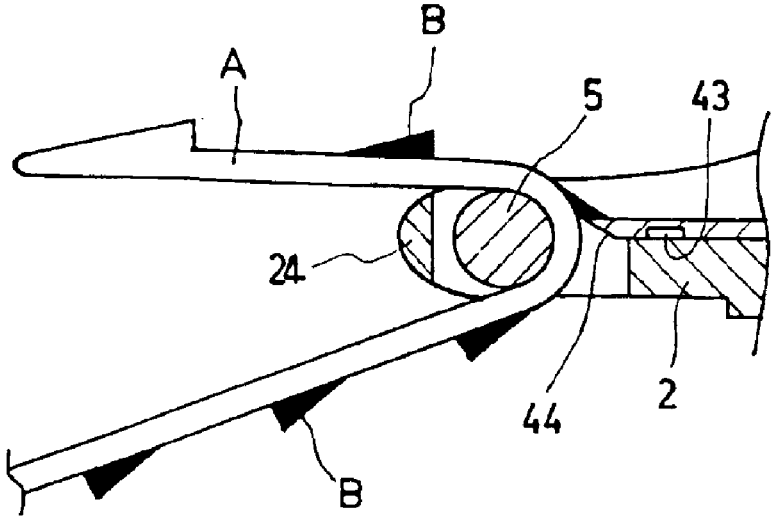
FIG. 3 is a fragmentary sectional view of the headband adjustment illustrating the headband being actuated.

Referring to FIG. 3 with reference to FIG. 2 again, when the headband is adjusted the tightness thereof, the two press pieces 3 at both lateral sides of the adjustment device can be pressed to move the press slant ends 32 inward so as to lift the guide grooves 43 upward gradually by way of the slant surface of the respective press slant end 32 and it results in a larger space between the plate slants 44 and the band shafts. Thus, the ratchet teeth B can pass through the space when the headband A is dragged or loosened and the required length adjustment for the headband can be obtained. After that, the press pieces 3 are released and the springs 313 expand outward to move the press slant end 32 outward such that the plate slants 43 can descend with the resilient adjustment plate 4 to the original state of locating with the ratchet teeth B being blocked.

As the foregoing, it can be understood that the headband adjustment device of the present invention is placed at the back of the head and the adjustment of headband A is performed by way of pressing the press pieces 3.

Nevertheless, a single press piece can be used at one lateral side of the adjustment device to perform the function of adjustment instead of the preceding two press pieces 3.

Therefore, it is appreciated that the headband adjustment device of the present invention can be mounted at the back of the head effectively to overcome the deficiency of the conventional adjustment device having increasing sized parts at both lateral sides of the head and to increase the space for modeling design thereof. Furthermore, it has been mentioned that the headband adjustment device is suitable for such as lunettes, protective spectacles and headlamp and it is a new field of innovative headband adjustment device.

While the invention has been described with reference to a preferred embodiment thereof, it is to be understood that modifications or variations may be easily made without departing from the spirit of this invention, which is defined by the appended claims.

What is claimed is:

1. A headband adjustment device, comprising:

a base;

an adjustable seat, being joined to the base, at two opposite lateral sides thereof having a wing plate respectively and at both ends thereof having an adjusting frame with a tying band with a plurality of ratchet teeth respectively;

at least a press piece, being disposed beside the wing plate;

a resilient adjustment plate movable between pressed and released positions, such that, in the released position, the resilient adjustable plate engages the ratchet teeth on the tying band; and in the pressed position, the press piece separates the resilient adjustment plate and the ratchet teeth on the tying band such that the tying band is adjustable.

2. The headband adjustment device as defined in claim 1, wherein the base is pierced with a base hole and the wing plates have a wing hole corresponding to the base hole so that the base and the wing plates are joined to each other with a base pin passing through the wing holes and the base hole.

3. The headband adjustment device as defined in claim 1, wherein the press piece extends at least one press bars forward with a clearance between the press bars to receive one of a spring and a plastic piece that exerts outward pressure and both ends of the press piece extends forward a press slant end respectively.

4. The headband adjustment device as defined in claim 1, wherein the resilient adjustment plate is one of flat and curved with a middle plate top and at both lateral sides of the plate top has a fixing projection respectively to engage with a guide hole provided at the respective wing plate.

5. A headband adjustment device, comprising:

a base;

an adjustable seat, being formed with two opposite lateral wing plates and at both ends thereof having an adjustment frame respectively, the wing plates being provided connecting with a base; with a wing hole respectively corresponding to the base hole, an engaging hole being arranged on top of the respective wing hole with a plate hole being disposed near two lateral sides of the plate hole and both ends of the respective wing plate being provided with an engaging hole;

at least a press piece, extending at least one press bars forward with a clearance between the press bars to receive a resilient member selected from a spring and plastic piece with outward exerting pressure and both ends of the press piece extends forward a press slant end respectively and the pressing bars at outer sides thereof have a jaw respectively;

a resilient adjustment plate, one of flat and curved with a middle protrusion top and at both lateral sides of the protrusion top having a fixing projection respectively, at a bottom near both ends thereof having a lift guide groove with a plate slant extending toward the two ends respectively; and two band shafts, at both ends thereof extending an end projection respectively;

whereby, the adjustable seat is connected to the base by way of the press bars passing through the engaging slots with the press slant ends being inserted into the plate holes, the resilient member with outward exerting pressure are placed in the bar clearances, the end projections of the band shafts are inserted into the engaging holes and the fixing projections of the resilient adjustment plate are engaged to the guide holes; the band shafts are enclosed with a headband and the headband inversely extends outward via the adjustment frames; the headband is provided with a plurality of unidirectional ratchet teeth engaging with the resilient adjustment plate to hold the headband in place; and when the two press pieces are pressed, the press slant ends move to lift the guide grooves upward and produce space between the plate slants and the band shafts for the headband passing through for adjustment.

6. The headband adjustment device as defined in claim 5, wherein the base has a thick central area and becomes getting thinner toward both ends thereof.

7. The headband adjustment device as defined in claim 5, wherein the base at a top thereof is a flat surface with a base recess and the adjustment seat has two horizontal plates corresponding to the base recess to form a groove.

8. The headband adjustment device as defined in claim 5, wherein the respective jaw has a shape of outward expanding wedge.

9. The headband adjustment device as defined in claim 5, wherein the protrusion top of the resilient adjustment plate has an arched or flat upper side.

10. The headband as claimed in claim 5, wherein said wing plate having a wing hole respectively corresponding to the base hole, a base pin is inserted to pass through the base hole and the wing holes.

11. The headband as claimed in claim 5, wherein said wing plate is glued with said base.

* * * * *